United States Patent [19]

Maguina-Larco

[11] Patent Number: 5,027,535

[45] Date of Patent: Jul. 2, 1991

[54] BOLTLESS HOLDING CLAMP FOR EARTH WORKING CUTTING TEETH

[76] Inventor: Alfredo Maguina-Larco, Catalino Miranda Av. No 600. Surco, Lima, Peru

[21] Appl. No.: 594,545

[22] Filed: Oct. 9, 1990

[51] Int. Cl.[5] ..... E02F 9/28

[52] U.S. Cl. ..... 37/141 T; 37/142 R

[58] Field of Search ..... 37/141 T, 142 R, 141 R, 37/142 A

[56] References Cited

U.S. PATENT DOCUMENTS

| | | | |
|---|---|---|---|
| 2,222,071 | 11/1940 | Gustafson . | |
| 2,729,902 | 1/1956 | Launder . | |
| 2,780,014 | 2/1957 | Arps . | |
| 2,940,192 | 6/1960 | Lattner . | |
| 3,345,765 | 10/1967 | Petersen . | |
| 3,750,761 | 8/1973 | Smith . | |
| 4,136,469 | 1/1979 | Zepf | 37/141 T |
| 4,414,764 | 11/1983 | Johansson et al. | 37/142 A X |
| 4,576,239 | 3/1986 | Launder . | |
| 4,611,418 | 9/1986 | Launder | 37/141 T |
| 4,712,321 | 12/1987 | Berchem et al. | 37/141 T X |
| 4,932,145 | 6/1990 | Reeves, Jr. | 37/141 T |

*Primary Examiner*—Dennis L. Taylor
*Assistant Examiner*—J. Russell McBee

[57] ABSTRACT

A boltless U-shaped holding clamp for wedgedly clamping cutting teeth to scarifier shanks of earth moving equipment. The clamp includes a first receiving channel having inclined bearing surfaces for engaging locking grooves of the snout of the scarifier shank, and a second receiving channel defined by a flat portion of the shank and the U-shaped member to receive an elongated cutting tooth of constant transverse cross section. The U-shaped clamp member is formed of a material having a certain modulus of elasticity to provide a resilient wedging force between the clamp and shank so as to absorb impact and vibrational forces applied to the tooth under load conditions, while the tooth material is a substantially hardened material for providing good wear resistance. The clamp is designed to translate substantially all of the clamp-to-shank wedging force to a frictional contact force between the tooth and the clamp, which in turn, develops a frictional contact force between the tooth and the shank. The clamp-to-tooth frictional contact force exceeds the tooth-to-shank frictional force whereby to facilitate greater wedging engagement of the clamp when axial loads are applied to the tooth. Greater clamp-to-tooth frictional contact can be attained by providing a tooth which is wider than the thickness of the shank. A worn tooth may be extended by being adjustably clamped against the shank thereby providing greater consumption of the tooth material, or alternatively, by placing abutments and/or spacers in the receiving channel of the clamp to extend the tooth.

33 Claims, 5 Drawing Sheets

BOLTLESS HOLDING CLAMP FOR EARTH WORKING CUTTING TEETH

CROSS-REFERENCE TO RELATED PATENTS AND APPLICATIONS

This invention is related to the subject matter of U.S. Pat. No. 4,899,830 titled "Cutting Tooth Assembly For Earth Working Machines" issued Feb. 13, 1990 to the same inventor hereof, which is incorporated herein by reference.

FIELD OF THE INVENTION

This invention relates to a boltless holding clamp for use with replaceable cutting teeth of earth working equipment, such as an earth moving machine, an agricultural machine, mining equipment, or a machine generally used in the construction and mining industries. Typical machines include bulldozers, scarifiers, rippers, excavators, backdiggers, power shovels and rotary cutting machines.

BACKGROUND OF THE INVENTION

An earth working machine typically utilizes a digging or cutting member which employs a plurality of shanks to which teeth are attached by a variety of means including welding, bolting, and wedge-fitting. It has been recognized that holding clamps for holding teeth to shanks provide certain advantages over current boltless connecting systems. This advantage stems from different conflicting physical requirements of the cutting teeth and the holding mechanism. The cutting point of the tooth must be formed of a hard wear-resistant material while the holding mechanism usually requires a material of at least some elasticity and/or ductility.

As widely practiced in the art, a tooth may connect to a shank by a wedging force between a groove in the shank and an aft coupling head of the tooth. Such an arrangement permits quick hammer-driven changing of worn teeth, as shown, for example, in U.S. Pat. No. 2,222,071 issued to Gustafson. The availability of rapid changing reduces costly down time, thereby permitting more economical operation of the equipment. A wedge coupling mechanism, however, requires a material having defined stress-strain characteristics, e.g., a certain amount of ductility or elasticity in the tooth coupling head to permit adequate wedging engagement and resilient clamping force between the tooth and the shank to absorb impact forces under working load conditions, or to provide adequate clamping under conditions where centrifugal forces act to loosen the tooth. On the other hand, the cutting point of the tooth mandates use of an extremely hard wear-resistant material having de minimis flexural properties. Consequently, conventional cutting teeth must either be manufactured in two stages to achieve the opposing requirements of the cutting point and coupling head, which renders it expensive. Alternatively, if the tooth is made in one operational stage, the hardness-ductility parameters of the coupling head and cutting point must be compromised, in which case the tooth wears out prematurely, thus leading to more costly down time and tooth replacement cycles.

As also known, the cutting or digging member of an earth working machine is subjected to severe impact and abrasive forces. It very often happens that the tooth attachment system is also subjected to those same forces which impose mechanical deformations upon the attachment system. Such deformations, in turn, interpose difficulties in changing or adjusting worn cutting teeth thereby causing more costly down time. Moreover, impact forces induce vibrations which tend to loosen threaded fasteners.

It is also highly desirable to provide a holding clamp adapted for use with an "adjustable" cutting tooth so that a tooth having a worn tip or cutting point might be quickly extended and re-fastened to the shank of the digging member. By adjustable, it is meant that the tooth may be loosened in the holding assembly, axially extended forward of the digging member of the earth working machine, and then refastened to the shank by the holding clamp. Provision of rapid adjustment provides substantial economic benefits in reduced machine down time and reduced teeth replacement costs since a substantial portion of the expensive tooth material may be consumed, rather than discarded. A tooth holding clamp utilizing fasteners such as bolts, dowel pins, screws or the like, such as shown by U.S. Pat. No. 3,750,761 to Smith et al., although adaptable for use with adjustable cutting teeth, suffers not only from the laborious slow-pace tooth changing or adjustment process, but also from mechanical deformation and loosening of the fastener heads occurring during digging or cutting operations.

U.S. Pat. Nos. 2,940,192 to Lattner and 4,576,239 to Launder show non-adjustable teeth-holding clamps which suffer, inter alia, from the lack of adjustability of the clamped position of the cutting tooth relative to the shank, and thus will impose significant operating costs on the end user. Not only are their cutting teeth non-adjustable, which requires the discarding of a substantial amount of specially treated and formed hard wear-resistant material of the teeth, but their teeth have relatively complex physical dimensions which add to their cost of manufacture since they cannot be conveniently fabricated from readily available bar stock material. In addition, the holding force provided by Lattner's clamp may be inadequate under certain extreme load conditions since the wedging force is partly divided between the lateral and vertical directions viewing a cross-section of the tooth and clamp from an axial direction. Lateral clamping forces do little to aid frictional holding between the tooth and the shank under impact loads. Further, the respective surface areas of shank-tooth and tooth-clamp frictional contact in an x-z plane may be inadequate to offset certain levels of impact forces encountered in the z-direction in relation to the width of Lattner's tooth. In addition, Lattner's tooth may not adequately drive the clamp into greater clamping engagement during installation of the tooth.

Launder, on the other hand, may also suffer the same drawbacks, particularly since surface area frictional contact is limited to mated clamp-to-tooth curvilinear contact (which diminishes tooth-to-shank frictional holding for a given clamp-to-shank wedging force), and a relatively wide gap exists between the tooth and clamp side walls which seemingly permits lateral instability of the tooth in the x-direction during impact loads. Launder, in fact, teaches away from tooth-to-clamp side wall contact in order to attain ease in alignment, and apparently, to permit separation of the clamp-tooth assembly. Above all, Launder's tooth does not self-tighten in response to axial loads applied to the tooth and cannot be positionally adjusted since there is no clearance in the z-direction between the length of the clamp receiving channel, on one hand, and the distance between the lateral ear projections and the stopwall of the tooth, on the other hand. In addition, Launder has little or no means for providing resiliency in the clamping force.

In view of the foregoing, the present invention has as its objective a primary purpose to overcome the foregoing drawbacks of prior holding clamps. In brief summary, the objectives of the present invention include providing a holding clamp which permits the use of bar stock material of constant cross section to form a cutting tooth of a hard wear-resistant material, providing means for positionally adjusting the clamped position of the cutting tooth on a shank of an earth working digging or cutting member, providing a holding clamp of a material having a given stress-strain characteristic which provides a modulus of elasticity necessary to maintain clamp-to-shank wedging forces and for absorbing forces impacted upon the tooth during digging or cutting operations, providing a holding clamp which enables quick connecting and disconnecting of a tooth in order to reduce equipment down time, providing a holding clamp which acts to tighten the wedging force upon impact loads applied to the tooth during digging and/or cutting operations, providing a holding clamp which requires no bolts or threaded fasteners thereby obviating disconnecting or adjusting difficulties due to deformations of the tooth fastening system, providing a holding clamp which is readily adapted to couple shanks and locking grooves used in construction, agricultural and mining equipment, providing a holding clamp which provides maximum restraint against tooth movement in the x-, y- and z- directions during cutting and digging operations when engaged in clamping relation, providing a holding clamp to provide maximum force translation between clamp-to-shank wedging action and tooth-to-shank frictional holding force, and providing a holding clamp having sufficient clamp-to-tooth contact surface area to offset extreme loading along the z-axis.

SUMMARY OF THE INVENTION

In accordance with the present invention, a boltless holding clamp comprises a U-shaped body of a material having a given stress-strain characteristic, said U-shaped body including a pair of appending flanges having wedge means for engaging locking grooves of a digging member shank of an earth working machine, said appending flanges further defining first channel means for receiving said shank member, said U-shaped body including a second receiving channel of uniform cross section for supporting a cutting tooth also of uniform cross section in frictional contact with said shank member, said flanges and said second receiving channel being adapted to translate substantially all of the shank-to-flange wedging force to a clamp-to-tooth and tooth-to-shank frictional contact force, said given stress-strain characteristic of said U-shaped body of material providing means to maintain sufficient frictional holding force against said tooth and for absorbing impact forces encountered by the tooth during digging operations.

Another aspect of the invention includes a cutting tooth adapted for use with the aforestated holding clamp wherein the cutting tooth comprises a hardened wear-resistant material of constant cross section complementary to the cross section of the second receiving channel.

In yet another aspect of the invention, the cutting tooth has a width which exceeds the thickness of the shank member thereby to provide greater tooth-to-clamp frictional surface contact which, in turn, enables increased shank-to-clamp wedging engagement during operation when the tooth is axially driven by impact forces that further drive the clamp upon the shank member. Moreover, during articulated digging, the wider tooth advantageously clears a swath for passage of the narrower shank member to reduce abrasive wear thereto.

Axial forces encountered during digging or cutting operations act to fasten the tooth securely to the shank. Thus, these forces can actually provide a self-tightening effect by driving the cutting tooth along with the holding clamp further into wedging and frictional engagement, with the holding clamp effectively preventing any loosening of the assembly due to its shape and stress-strain characteristic.

In some applications, such as machines with rotational cutting drums, there are also present vibrational and centrifugal forces acting in a direction opposite to those required for securing the tooth, which result in loosening. To reduce the likelihood of loosening, stops are attached to the tooth which abut the forward portion of the clamp thereby to force the clamp further into the frictional wedging grip with the main shank member during use of the cutting tooth.

For applications involving extremely high vibration levels, stops can be provided in the aft portion of the holding clamp holder. These stops provide an abutment for the cutting tooth, preventing aft movement of the tooth relative to the holding clamp when subjected to axial forces. These forces drive the cutting tooth along with the clamp further into clamping wedging engagement, thus effectively preventing any loosening of the tooth-clamp-shank assembly.

Advantageously, the tooth is easily changed or adjusted. When the tooth is worn, the clamp is loosened by hammer taps in the forward direction, the tooth is then positionally adjusted in the forward direction, and then the clamp is again engaged by hammer taps in the aft direction. Alternatively, the tooth may be replaced altogether. This sequence permits all but a minor length of the cutting tooth to be successively used.

Other aspects, features and advantages of the present invention will become more readily apparent upon review of the following description taken in connection with the accompanying drawings, all of which form part of this specification, wherein like reference numerals designate corresponding parts in the various figures.

DESCRIPTION OF ILLUSTRATIVE EMBODIMENTS

For the sake of clarity in illustration, the invention is described in connection with a single shank member of a digging member of an earth working machine, it being understood that the machine typically employs several such shank members as illustrated in my incorporated U.S. Pat. No. 4,899,830.

Figure 1A:
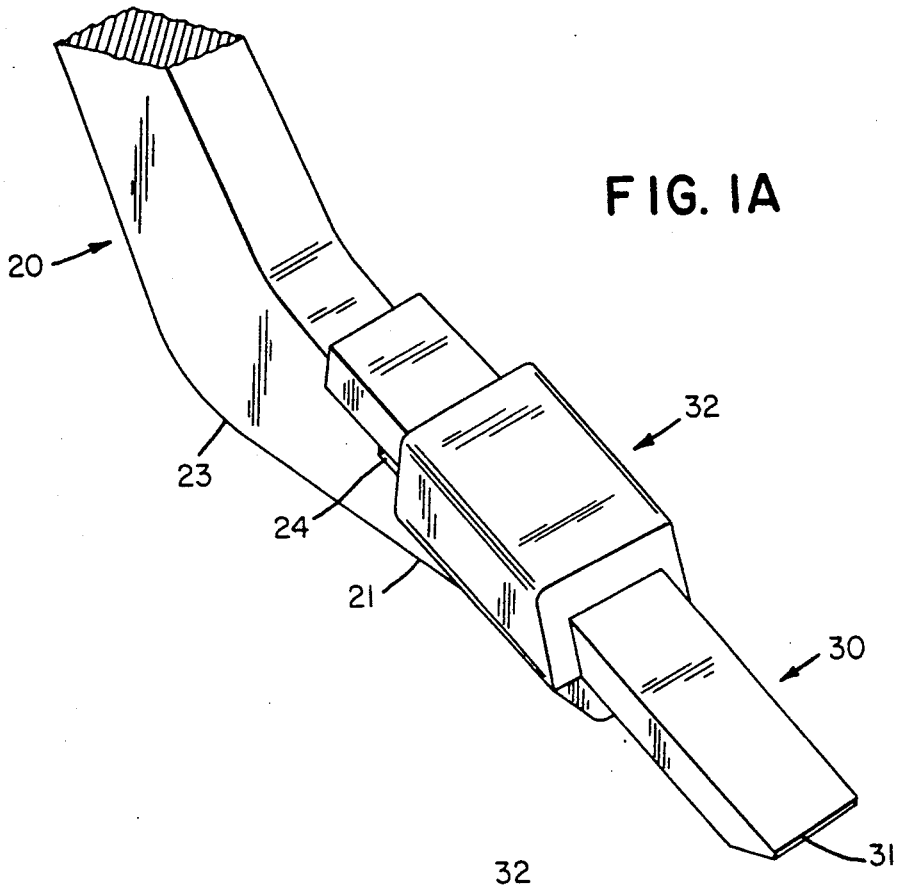
FIG. 1A depicts in assembled relation, a conventional shank member together with the holding clamp and cutting tooth of the present invention.
Figure 1B:
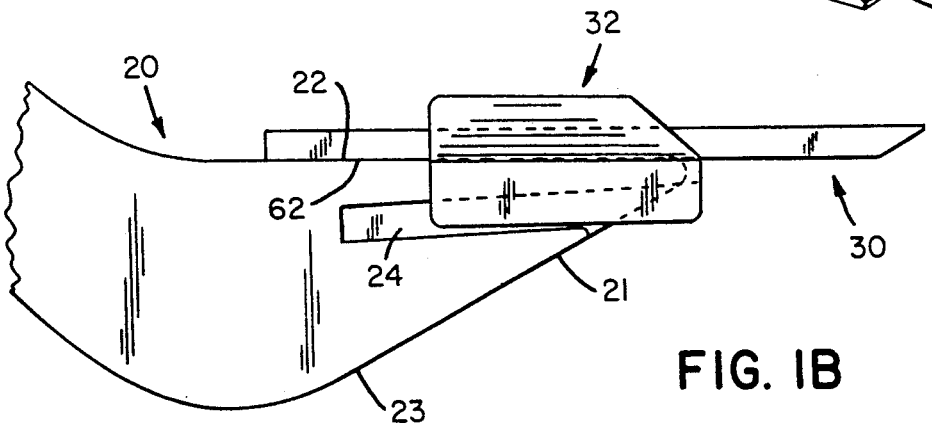
FIG. 1B is a side elevational view of the assembly shown in FIG. 1A.
Figure 2:
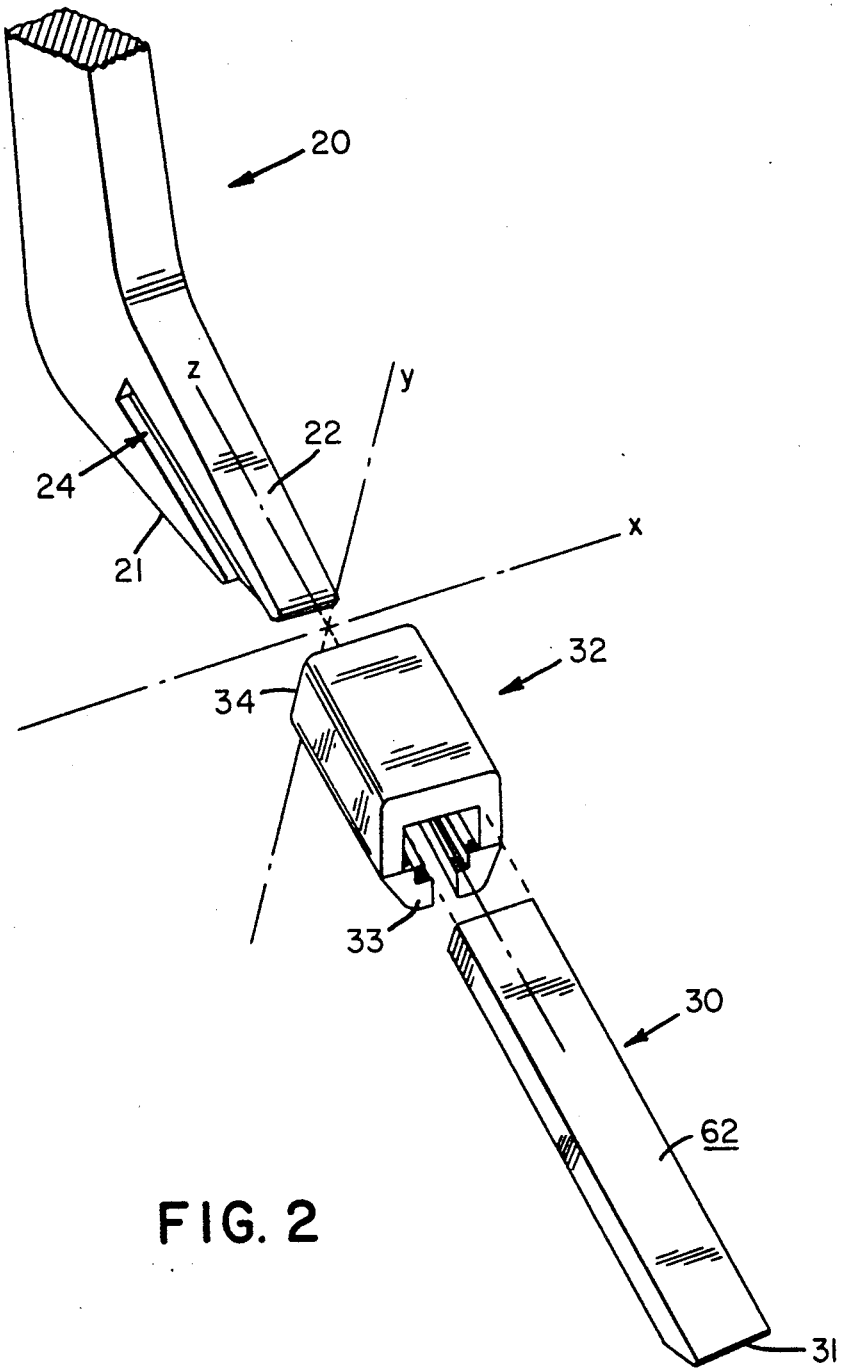
FIG. 2 is an exploded view of the assembly depicted in FIG. 1.
Figure 3A:
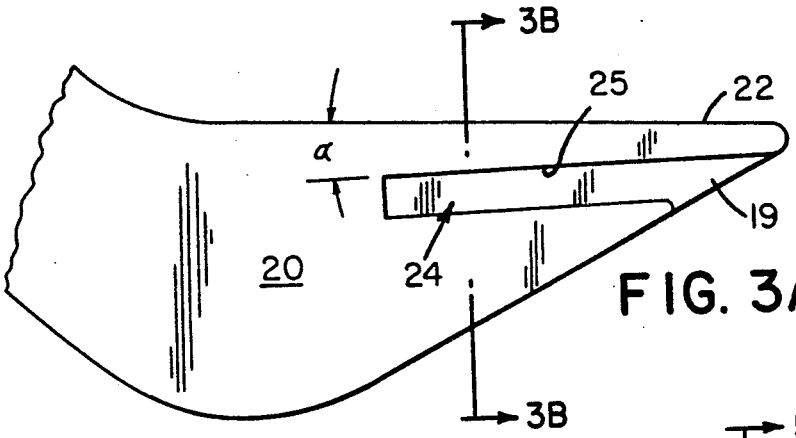
FIG. 3A is a side elevational view of the conventional shank depicted in FIG. 2.
Figure 3B:
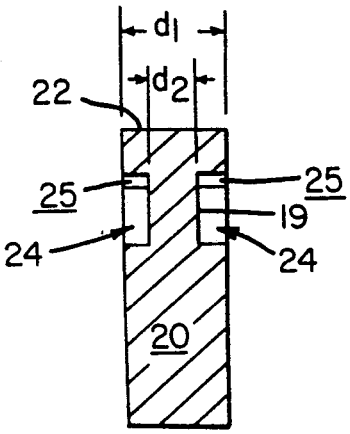
FIG. 3B is a cross-sectional view taken along line 3B—3B of the conventional shank member shown in FIG. 2.
Figure 4:
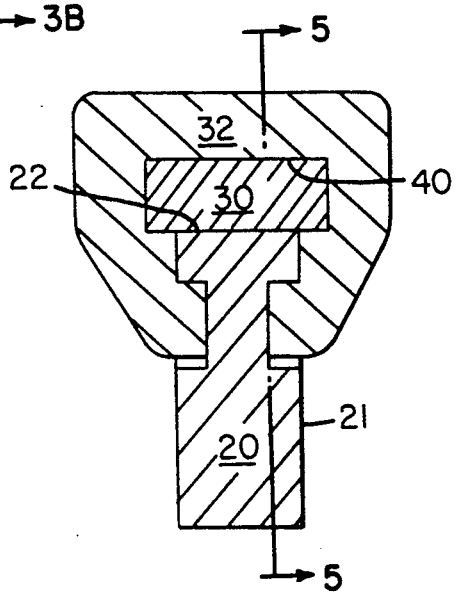
FIG. 4 is a cross-section view taken on the line 4—4 of the shank-tooth-clamp assembly depicted in FIG. 5.
Figure 5:
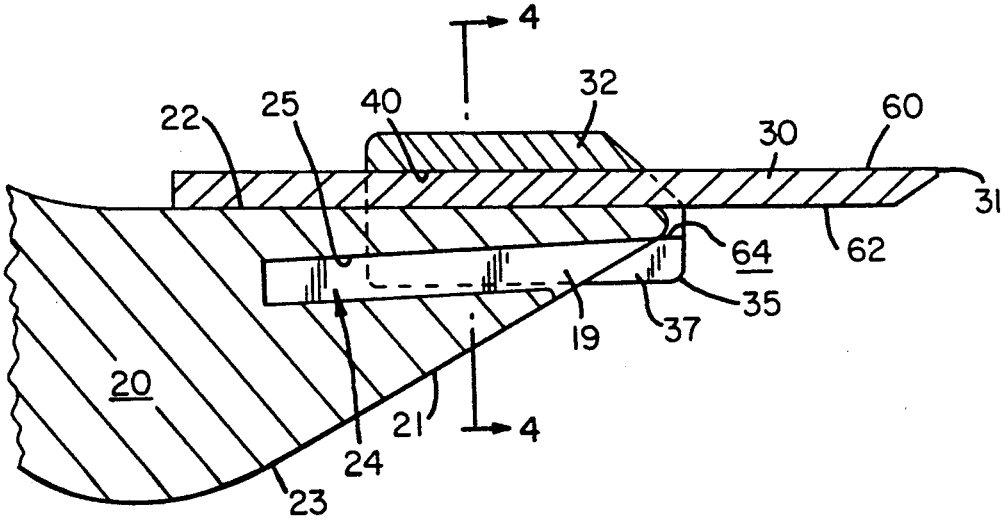
FIG. 5 is a cross-section view taken along line 5—5 of the shank-tooth-clamp assembly of FIG. 4.

FIGS. 1A and 1B herein depict one such shank member 20 to which the inventive holding clamp 32 clamps a cutting tooth 30, while FIG. 2 shows a spaced-apart view of the assembly of FIGS. 1A and 1B. The shank 20 is known in the art to be formed of a very hard steel and is connected to a digging or cutting member of the earth working machine (not shown) by dowels or other convenient means, as is conventional in the art.

Referring to both FIGS. 1A, 1B, 2, 3A, 3B, 4 and 5, the shank 20 of thickness d1 has a snout 21 which provides a planar surface 22, a pair of locking grooves 24 on each side of the shank member 20 forming a web 19 of thickness d2 in the shank 20, and a pair of inclined wedge-locking bearing surfaces 25 facing inwardly of the grooves 24. Planar surface 22 provides a bearing surface parallel to a z-axis (FIG. 2) against which the cutting tooth 30 bears in frictional contact when engaged. The snout 21 receives the clamp 32 and tooth 30 along the z-axis, and has a bottom surface 23 which also is inclined towards the free end of the shank 20, such that the bottom of the edge 23 lies within the radius of movement of a cutting tooth 30. The central longitudinal axis of tooth 30 parallels the z-axis. As apparent from the drawings, the width w of the cutting tooth 30 along the x-axis is greater than the thickness d1 of the shank 20. In some applications, though, the tooth width may be equal to or less than the shank thickness.

The respective bearing surfaces 25 of grooves 24 diverge from the surface of planar face 22 from the open end of the grooves, at a small angle $\alpha$ of, for example, 4°, more or less. The angle $\alpha$ of divergence is a fixed parameter of conventional shank members and defines excursions of clamping force along the y-axis for given movements of a U-shaped clamp 32 along the z-axis. To attain more desirable force excursions in relation to clamp movement, the invention advantageously provides a holding clamp 32 being formed of a material having either or both a special structural configuration or a predetermined stress-strain characteristic, e.g., ductility and/or modulus of elasticity. Further, planar surface 22 and the bearing surfaces 25 of locking grooves 24 are smooth surfaces providing for a relatively low friction coefficient.

Figure 6:
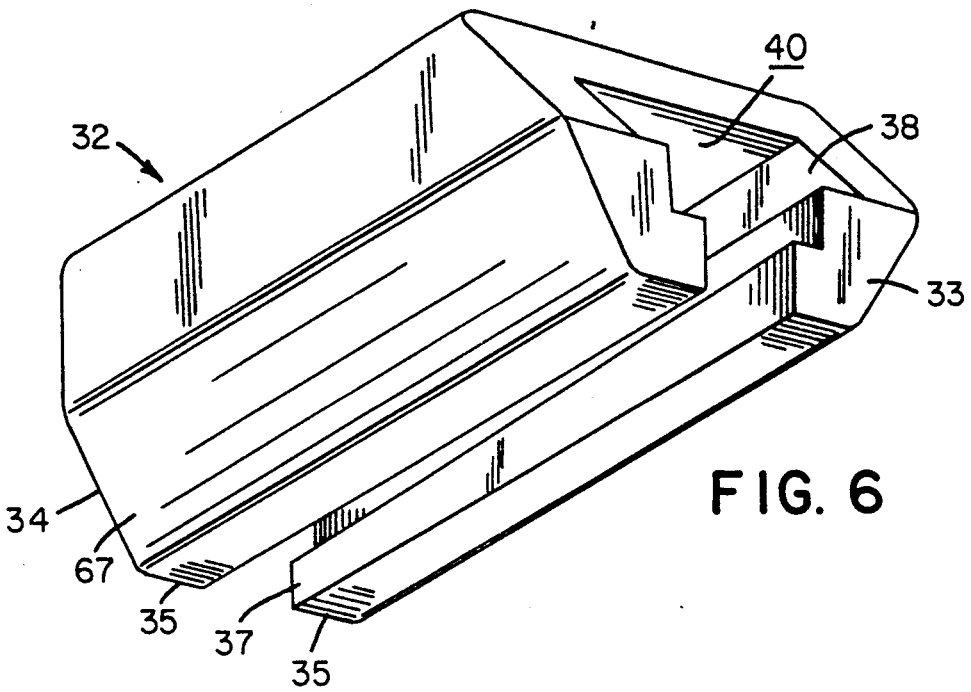
FIG. 6 is a perspective view of the inventive holding clamp shown in FIGS. 1 and 2.
Figure 7:
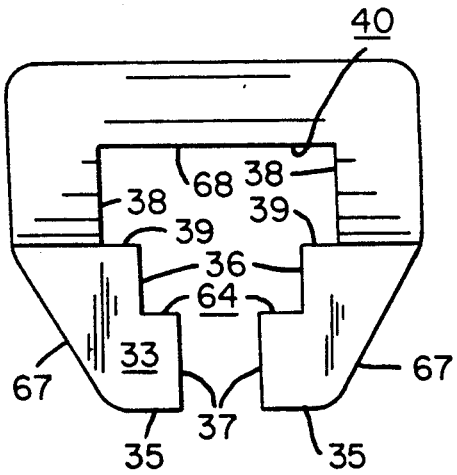
FIG. 7 is a front elevational view of the inventive holding clamp shown, in FIGS. 1 and 2.
Figure 8:
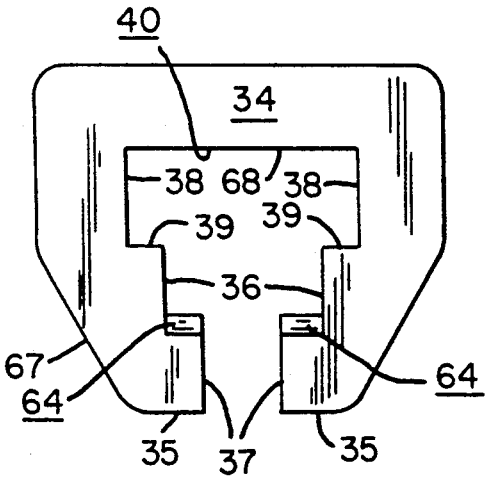
FIG. 8 is an aft elevational view of the inventive holding clamp shown in FIGS. 1 and 2.
Figure 9:
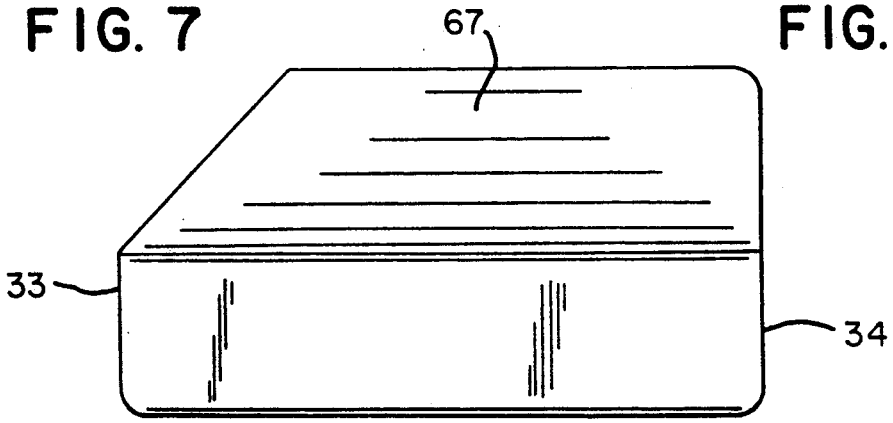
FIG. 9 is a side elevational view of the inventive holding clamp shown in FIGS. 1 and 2.

The U-shaped holding clamp 32, more particularly shown in FIGS. 6–8, has a front end 33 which receives the tooth 30 in a receiving channel, and a rear end 34 which is positioned upon the snout 21 of the shank 20. Respective legs 67 of the U-shaped clamp 32 include flanges 35 which longitudinally extend along the z-axis and are configured to fit into the grooves 24 of the snout 21. Each flange has an internal bearing surface 64 which is inclined from the z-axis in the same direction and in approximately the same amount as inclined bearing surface 25 of the groove 24 in the shank, e.g., approximately 4°. The surfaces 25 and 64 mate together when the clamp engages the snout. As previously noted, the extent of incline provides a fixed force excursion in relation to z-axis movements of clamp 32. However, these force excursions are improved by an aspect of the present invention in that the legs 67 provide some degree of resiliency, elasticity or ductility to absorb vibrational forces encountered by the tooth, thereby to reduce loosening tendencies.

The flanges 35 form a T-shaped channel for receiving a portion of the snout 21, which channel is defined by side walls 36, bearing surfaces 64, side walls 37 and a flat surface of tooth 30 when inserted in the receiving channel of the clamp. Side walls 37 are adapted to engage the web 19 of groove 24 to prevent angling of the clamp across the x-axis, although a certain amount of clearance is retained for unobstructed movement of clamp 32 upon snout 21. Planar surfaces 38, 39 and 40 of clamp 32 define the receiving channel to embrace cutting tooth 30, as previously mentioned.

Surface 40 is a friction surface which may be rougher than surfaces 39 to provide a higher coefficient of friction for surface 40 than surfaces 39. This allows surface 40 to better frictionally engage a surface of the cutting tooth. Surfaces 39 act as guiding surfaces for guiding the tooth into the receiving channel of the clamp. Side surfaces 38 prevent lateral displacement of the cutting tooth 30 in the receiving channel.

The cutting tooth 30 has a forward cutting edge 31, and preferably is in the form of a standard flat bar of steel. The cutting tooth 30 has a first flat surface 60 which bears against the surface 40 of the clamp 32 in clamping relation and a second flat surface 62 which bears against the flat surface 22 of the snout 21 in clamping relation. Preferably, the steel tooth has a hardness of about 50–70 on the Rockwell C scale and a resistance of bending of about 220 kPSI, or more, so that it can withstand the hard use to which it is to be subjected, and to resist wear and fatigue under the extremely high stresses imposed on the cutting tooth during use. Of course, these ranges may vary depending upon the desired application. Such hardness is not desirable for the clamp 32 for reasons discussed above.

One major face of the cutting tooth 30 is positioned directly on the planar face 22, and is secured in that position by the holding clamp 32. The clamp 32 is preferably made of forged steel having a modulus of elasticity which facilitates absorption of holding force vibrations, thus providing the holding clamp 32 with a greater elastic limit than that of tooth 30. In the preferred embodiment, the hardness of the clamp is less than the hardness of the tooth since they are designed to accomplish different functions.

In order to assemble the cutting tooth assembly, the cutting tooth 30 is inserted into the receiving channel of clamp 32, and the clamp is then positioned over the snout 21 of the shank 20, with its longitudinal flanges 35 embracing the web 19 of the locking grooves 24 of the snout. The cutting tooth 30 and the clamp 32 are then axially moved onto the snout 21, the bearing surfaces 64 of appending flanges 35 of the clamp at this time progressively moving along the complementary bearing surfaces 25 of locking grooves 24, thereby to move surface 40 of clamp 32 downwardly into clamping engagement with surface 60 of the cutting tooth 30 and in turn, to move surface 62 of the cutting tooth 30 into clamping engagement with the upper planar surface 22 of the snout 21.

All of the force occurring between surface 40 of the clamp 32 and surface 60 of the cutting tooth 30 and between surface 62 of the cutting tooth 30 and surface 22 of the snout 21 is provided by the clamping engagement between bearing surfaces 64 of the clamp 32 and surfaces 25 of the snout 21. The clamping engagement and holding power of the cutting tooth assembly is greatly enhanced by concentrating all of the holding forces at the small areas of engagement between the bearing surfaces 64 and surfaces 25. The holding power is also enhanced by the increased ductility and/or elasticity of the clamp, as compared to the conventional devices, since this increased ductility or elasticity allows the clamp 32 to better "grab" or clamp onto snout 21 by absorbing at least a portion of the wedging force between the clamp 32 and the snout 21. The metallic material of clamp 32 may have some ductility so as to actually deform slightly under anticipated clamping forces to assure contiguous mating contact between the bearing surfaces 25 (FIG. 3) and 64 (FIG. 8). However, such deformation is not necessary so long as at least some elasticity is provided by the clamp structure or the clamp material, e.g., the anticipated forces remain within the elastic limit of the clamp.

It will be observed that any axial forces along the z-axis exerted on the cutting edge 31 of the tooth 30 will be acting in the same direction required to move the clamp 32 into greater frictional engagement with the snout 21. In this regard, an aspect of the invention advantageously provides a tooth 30 having a width w greater than the thickness d1 of the shank 20 so that a greater frictional contact area is provided between clamp 32 and tooth 30 than is provided between the tooth 30 and shank surface 22. In this manner, axial forces on tooth 30 act first to drive the clamp 32 into tighter wedging engagement as the tooth 30 and clamp 30 slide together over the shank surface 22, instead of the tooth sliding between the clamp 32 and shank surface 22. Alternatively, this feature may be provided by roughening the surface 40 of clamp 32, as previously mentioned. Also, in accordance with an important aspect of the present invention, it is apparent that impacts by stones and the like on the front end 33 of the clamp 32 also act to move the clamp into closer frictional engagement with the cutting tooth 30 and the snout 21.

To release the clamp 32 for adjustment or replacement of the cutting tooth 30, it is merely necessary for a sharp blow to be delivered to the rear end 34 of clamp 32.

As will be observed, the cutting tooth 30 is of constant transverse cross-section throughout its length and fits into a complementary receiving channel of the U-shaped clamp 32. The receiving channel in the clamp 32 also is of constant transverse cross-section throughout its length. Thus, prior to engaging the clamp 32, the cutting tooth 30 can be adjusted forwardly or rearwardly within the channel of clamp 32 to the desired length since it advantageously consists of bar stock material of constant transverse cross section. Once the cutting tooth 30 has worn down to an extent requiring its extension, it can be extended merely by loosening the clamp 32, sliding the cutting tooth 30 forwardly and then re-tightening the clamp 32.

Figure 10:
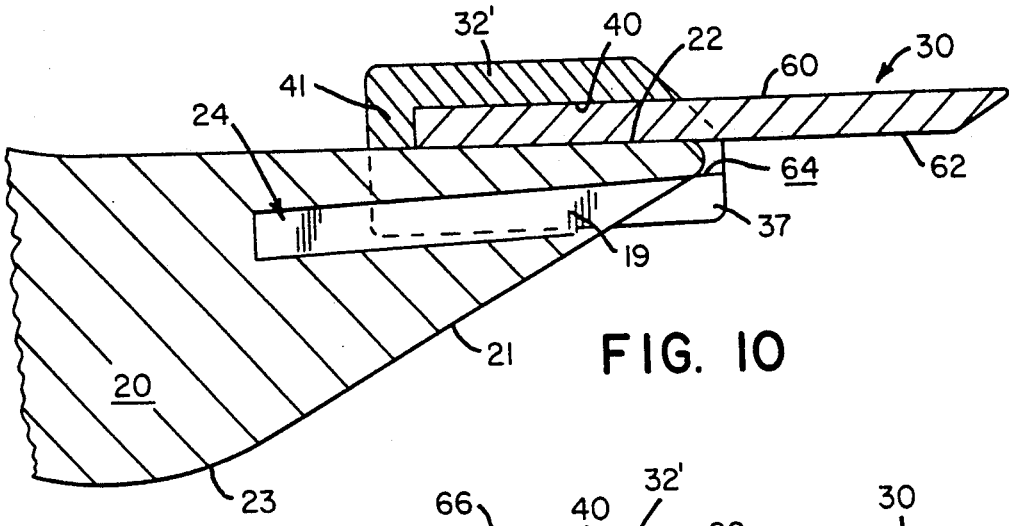
FIG. 10 illustrates an alternative embodiment of the invention which incorporates a stopper means in the clamp for positively transmitting tooth forces directly to the clamp.
Figure 11:
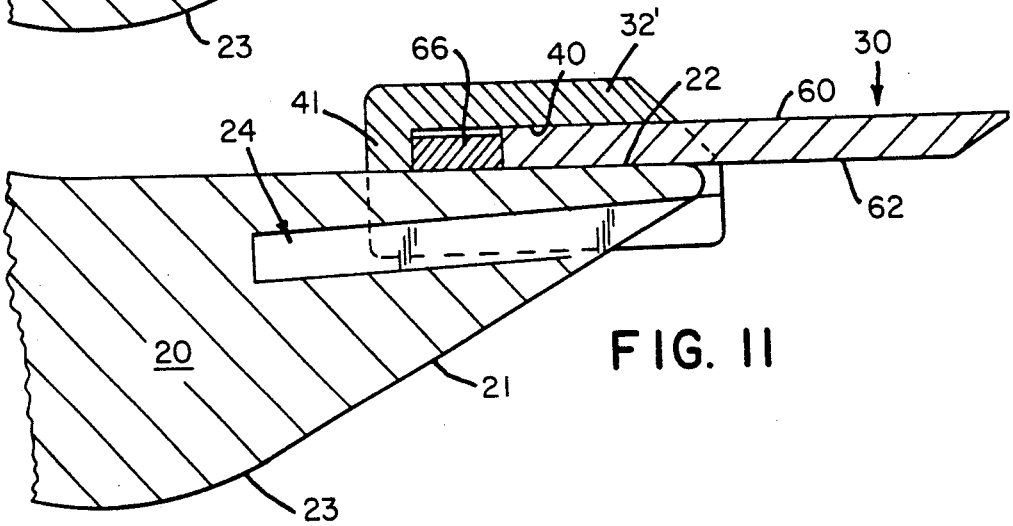
FIG. 11 illustrates yet a further embodiment of the invention which employs spacer blocks to attain adjustability of tooth position.
Figure 12A:
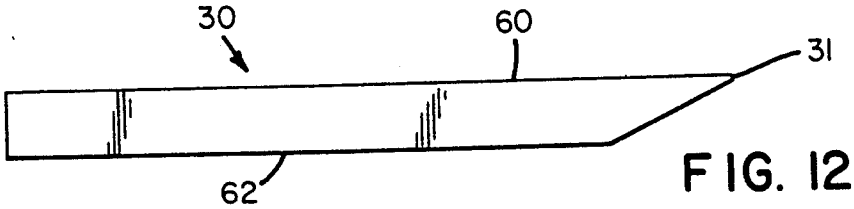
FIG. 12A is a side elevational view of a preferred tooth for use with the inventive clamp.
Figure 12B:
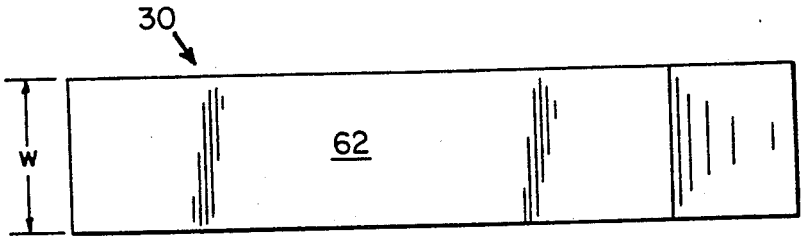
FIG. 12B is a top elevational view of a preferred tooth for use with the inventive clamp.

Other means may be provided for attaining the important aspect of increased clamping engagement in response to axial forces upon the tooth 30. For example, as depicted in FIGS. 10 and 11, an abutment or stopper means 41 may be formed in the aft portion of receiving channel of the clamp 32 to provide a positive stop against further rearward movement of the cutting tooth 30 relative to the clamp 32. The stopper means 41 preferably is integrally formed with the clamp 32, but may be attached by other means, such as by welding or by use of a fastener. In this alternative embodiment, axial forces exerted on the cutting edge 31 of the cutting tooth 30 will be transmitted directly to the stopper means 41 of clamp 32, which will act to force the clamp into further wedging engagement with the shank member 20, which in turn, applies a further y-axis force directly upon the tooth 30 thereby to achieve the self-tightening aspect of the present invention. Alternatively, self-tightening may be achieved by provided stops directly upon the tooth 30 as described in my prior U.S. Pat. No. 4,899,830, but not without sacrifice of the tooth adjustability feature of the invention.

In the case where the stopper means 41 is formed in the holding clamp 32, the adjustability feature is attained by use of spacers in the receiving channel between the stopper means 41 and the rear end of a tooth 30, as shown in FIG. 11. The spacers may differ in length, the objective being to provide means to extend a worn tooth but yet retain a sufficient surface contact area between the clamp, tooth and shank.

For precise adjustment of the cutting tooth 30 in the clamp 32, the alternative embodiment of the cutting tooth assembly uses spacer block 66. The spacer block 66 is thinner and/or narrower than the cutting tooth 30 so as not to interfere with the frictional engagement of the cutting tooth 30, clamp 32 and snout 21. The spacer block 66 is inserted into the receiving channel of the clamp 32. One end of the spacer block 66 contacts the stopper means 41 provided at the rear of the clamp 32. The other end of the spacer block 66 contacts a rear edge of the cutting tooth 30. In this way, the cutting tooth 30 is extended from the clamp 32 by the length of the spacer block 66, whereupon the cutting tooth 30 is locked in place.

Different lengths of spacer blocks 66 are used as the cutting teeth 30 wear down or for different adjustments of the cutting teeth 30. The spacer blocks 66 can be constructed from almost any solid material including metal, plastic or wood since the spacer blocks 66 are not exposed to great forces after the cutting tooth 30 is locked into place.

Even though there is a smaller area of frictional engagement between the cutting tooth 30, clamp 32 and snout 21 as the cutting tooth 30 is extended from the cutting tooth channel, the cutting tooth 30 will still be held in place since the clamping force will be concentrated in this area. Therefore, the clamping pressure will be higher as it is applied to a smaller engagement area, maintaining the cutting tooth 30 in place. An engagement between the cutting tooth 30 and the clamp 32 of approximately 25 millimeters is all that is required to properly hold the cutting tooth 30 in place when the clamp 32 is clamped down.

Eventually, there will be an insufficient length left of the cutting tooth 30 for it to be adequately clamped by the clamp 32. At this point, it is necessary to replace the cutting tooth 30.

While various embodiments of the invention have been described in accordance with what is presently conceived to be the most practical and preferred embodiment, it is to be understood that the invention is not to be limited to the disclosed embodiments, but on the contrary, is intended to cover various modifications and equivalent arrangements included within the spirit and the scope of the appended claims, which scope is to be accorded the broadest interpretation of such claims so as to encompass all such equivalent structures. For example, the clamp need not necessarily be U-shaped and its resiliency may be attained in several ways without departing from the spirit of my invention. Resiliency in holding force may be provided by the stress-strain characteristics of the clamp material or by a spring effect attained by the physical structure of the clamp, e.g., by specially designing the flange, legs or mid-section of the clamp. The differential axial tooth-to-clamp and tooth-to-shank frictional holding forces may be attained by different amounts of surface area contact, or by differential frictional properties between the respective surfaces. The cross sectional areas of the tooth and clamp receiving channel may take on a variety of forms. Adaptors and spacers may be utilized in a variety of ways without departing from the spirit of my invention. Alternative shank designs may also be utilized. Relative hardness, elasticity, and ductility qualities of the tooth and clamp material may vary from illustrated values, depending upon the application to which the tooth is put. Although metal is commonly used for such materials, my invention is not limited thereto, but is intended to embrace composites, plastics and other suitable materials to achieve resilient self-clamping and abrasive cutting. Accordingly, it is my intent to include all such modifications and adaptations as may come to those skilled in the art.

What is desired to be secured by United States Letters Patent is:

1. A boltless holding clamp adapted for coupling locking grooves of a shank member of an earth working machine, said clamp developing a shank-to-clamp wedging force when positioned in clamping engagement and comprising:

A. a U-shaped body of material having a predetermined modulus of elasticity for providing a resilient holding force and being adapted for translating substantially all of said shank-to-clamp wedging force to a clamp-to-tooth and tooth-to-shank frictional contact force for holding a cutting tooth, said U-shaped body including:

i. a pair of appending flange means for engaging said locking grooves of said shank member and for defining a T-shaped receiving channel for receiving a portion of said shank member between said pair of appending flange means, ii. said flange means further including an inclined bearing surface for bearing against the locking grooves of said shank when axially positioned onto said shank, and iii. said U-shaped body and said shank member further defining a second receiving channel means of uniform transverse cross section for receiving a cutting tooth in axial alignment within said second receiving channel means wherein said tooth also has a uniform transverse cross section, said second receiving channel means further including friction surface means for bearing against said cutting tooth when positioned in said second receiving channel means in clamping engagement and a pair of side walls for restraining lateral displacement of said tooth when positioned in said receiving channel means.

2. A holding clamp as recited in claim 1 wherein a clamp-to-tooth frictional surface area of said second receiving channel means provides sufficient frictional contact force when in clamping engagement to drive said clamp into further axial clamping engagement upon application of axial loads to said tooth during cutting or digging operations.

3. A holding clamp as recited in claim 1 having a clamp-to-tooth frictional force which exceeds a tooth-to-shank frictional force when engaged in clamping relation thereby to assure increased wedging engagement upon application of axial loading forces to said cutting tooth.

4. A holding clamp as recited in claim 1 wherein the width of said second receiving channel means for said cutting tooth is greater than the thickness of said shank member whereby to provide a greater tooth-to-clamp frictional force.

5. A holding clamp as recited in claim 1 wherein said U-shaped body is formed of a ductile material to provide a resilient clamp-to-shank wedging force.

6. A cutting tooth for use with the holding clamp as recited in claim 1 comprising a hardened, wear-resistant material of constant cross section complementary to and for insertion into the cross section of said second receiving channel means.

7. A cutting tooth for use with the holding clamp as recited in claim 4 comprising a hardened, wear-resistant material of constant cross section complementary to and for insertion into the cross section of said second receiving channel means.

8. A cutting tooth for use with the holding clamp recited in claim 5 comprising a hardened, wear-resistant material of constant cross section complementary to and for insertion into the cross section of said second receiving channel means.

9. A holding clamp as recited in claim 2 wherein at least a portion of the internal surface of said second receiving channel means for receiving said tooth is treated to increase its frictional properties.

10. A holding claim as recited in claim 1 wherein at least a portion the second receiving channel means for receiving said tooth is structurally configured to resiliently bear against said tooth when engaged in clamping relation whereby to provide extended resiliency in clamping force to absorb greater vibrational forces applied against said tooth.

11. A holding clamp as recited in claim 1 wherein said U-shaped body includes stop means in an aft portion thereof for abutting against a tooth when positioned in said receiving channel means.

12. A holding clamp as recited in claim 11 further including spacer means for being placed in said receiving channel means aft of said tooth for providing adjustment means for said tooth.

13. A holding clamp as recited in claim 12 wherein said spacer means has a lesser cross sectional area than said tooth adapted for insertion into said receiving channel means.

14. In combination, a cutting tooth formed of a hardened material of constant cross section and including a cutting point at one end thereof, and a boltless holding clamp adapted for coupling locking grooves of a standard shank member of an earth working machine, said clamp developing a shank-to-clamp wedging force when positioned in clamping engagement and wherein said clamp comprises:

A. a U-shaped body of material having a predetermined stress-strain characteristic for providing a resilient holding force and being adapted for translating substantially all of said shank-to-clamp wedging force to a clamp-to-tooth and tooth-to-shank frictional contact force for holding said cutting tooth, said U-shaped body including:

i. a pair of appending flange means for engaging said locking grooves of said shank member and for defining a first receiving channel for receiving a portion of said shank member between said pair of appending flange means, ii. said flange means further including an inclined bearing surface for bearing against the locking grooves of said shank when axially positioned onto said shank, and iii. said U-shaped body and said shank member further defining a second receiving channel means of uniform cross section for receiving said cutting tooth also of uniform cross section in axial alignment within said second receiving channel means, said second receiving channel means further including friction surface means for bearing against said cutting tooth when positioned in said second receiving channel means in clamping engagement and a pair of side walls for restraining lateral displacement of said tooth when positioned in said receiving channel means.

15. A boltless holding clamp adapted for coupling locking grooves of a shank member of an earth working machine, said clamp developing a shank-to-clamp wedging force when positioned in clamping engagement and comprising:

A. a U-shaped body of material having a predetermined stress-strain characteristic for providing a resilient holding force and being adapted for translating substantially all of said shank-to-clamp wedging force to a clamp-to-tooth and tooth-to-shank frictional contact force for holding a cutting tooth, said U-shaped body including:

i. a pair of appending flange means for engaging said locking grooves of said shank member and for defining a first receiving channel for receiving a portion of said shank member between said pair of appending flange means, ii said flange means further including an inclined bearing surface for bearing against the locking grooves of said shank when axially positioned onto said shank, and iii. said U-shaped body and said shank member further defining a second receiving channel means of uniform cross section for receiving a cutting tooth also of uniform cross section in axial alignment within said second receiving channel means, said second receiving channel means further including friction surface means for bearing against said cutting tooth when positioned in said second receiving channel means in clamping engagement and a pair of side walls for restraining lateral displacement of said tooth when positioned in said receiving channel means.

16. A boltless cutting tooth assembly for use in an earth working machine having a digging member for providing adjustable clamping of a cutting tooth, said assembly comprising:

A. a shank connected to the digging member, said shank including at least one locking groove providing an inclined wedge-locking bearing surface;

B. a U-shaped holding clamp which couples the tooth to said shank, said clamp including:

i. a receiving channel of uniform cross section for supporting said tooth in axial alignment, said receiving channel including:

a. a friction surface which bears against a flat surface of said tooth when engaged in said receiving channel to define a clamp-to-tooth frictional contact force, b. side walls for guiding and preventing lateral displacement of said tooth in said receiving channel, ii. said U-shaped holding clamp having appending flanges which include a bearing surface to engage locking grooves of said shank and for translating substantially all of said wedging force to said clamp-to-tooth frictional contact force whereby to prevent vertical displacement of said tooth and holder when clamped together, said clamp comprising a ductile material adapted for absorbing at least a portion of the wedging force when placed in wedging engagement with said shank whereby to reduce loosening of the tooth during vibrational loading conditions, and C. said tooth comprising an elongated, hardened bar stock material of constant cross section and including a first bearing surface which bears against the friction surface of the clamp and a second bearing surface which bears against said shank when held in clamping relationship.

17. A boltless cutting tooth assembly as recited in claim 16 wherein the tooth-to-clamp frictional contact force exceeds the tooth-to-shank frictional contact force whereby axial loads upon the tooth act first to drive the clamp into greater clamping relation before the tooth axially slides upon said shank.

18. A boltless cutting tooth assembly as recited in claim 16 wherein the width of the cutting tooth is greater than the thickness of said shank whereby to provide greater tooth-to-clamp frictional contact.

19. A boltless cutting tooth assembly as recited in claim 16 wherein said cutting tooth comprises a hardened wear-resistant material having a rectangular cross sectional area.

20. A boltless cutting tooth assembly as recited in claim 16, wherein the holding clamp further comprises at least one abutment means extending into a rear portion of the receiving channel to limit axial displacement of the tooth in the channel.

21. A boltless cutting tooth assembly as recited in claim 20, further comprising:

a spacer block means inserted between the abutment means and the tooth to axially extend the tooth from the holding clamp by a length of the spacer block means, the cross sectional area of the spacer block means being thinner and narrower than the cross sectional area of the cutting tooth so as not to interfere with the clamping of the cutting tooth to the shank during clamping engagement.

22. A boltless holding clamp for frictionally clamping a cutting tooth including a portion of having a constant transverse cross section to a shank of a digging member of an earth working machine, said clamp comprising:

a U-shaped body of material having appending flange means for interlocking with locking grooves of said shank, said clamp including a receiving means for defining a channel of constant transverse cross section for receiving said tooth at adjustable axial positions therein, said clamp further including means for self-tightening said tooth against said shank in response to axial load forces applied to said tooth.

23. The invention as recited in claim 22 wherein said means for self-tightening comprises differential friction means between a tooth-to-clamp interface and a tooth-to-shank interface.

24. The invention as recited in claim 22 wherein said means for self-tightening comprises stopper means attached to said clamp for engaging said tooth during axial working loads applied to said tooth for driving said clamp into further clamping engagement with said shank.

25. A cutting tooth of constant transverse cross section for use with the invention recited in claim 22 wherein said tooth comprises a hardened, wear-resistant material of constant transverse cross section.

26. A boltless holding clamp for clamping a cutting tooth of constant transverse cross section to a shank of a digging member of an earth working machine comprising:

a U-shaped body of material having appending flanges for interlocking with locking grooves of said shank, said clamp including a receiving channel of constant transverse cross section for receiving said tooth at adjustable axial positions therein, said clamp further including means for self-tightening said tooth against said shank in response to axial load forces applied to said tooth, said clamp further including resiliency means for absorbing vibrations in clamping force between said tooth and shank.

27. The invention as recited in claim 26 wherein said resiliency means comprises a predetermined stress-strain characteristic of said clamp material.

28. The invention as recited in claim 26 wherein said resiliency means comprises a spring effect established by the physical structure of said U-shaped body.

29. A cutting tooth for use with the invention recited in claim 26 wherein said cutting tooth comprises a hardened, wear-resistant material formed from bar stock material.

30. The invention as recited in claim 26 wherein said receiving channel includes stopper block means for engaging said tooth during axial working loads applied to said tooth for driving said clamp into further clamping engagement with said shank.

31. The invention as recited in claim 30 further including spacer block means for providing adjustability of the axial position of said tooth.

32. The invention as recited in claim 24 further including spacer block means for providing adjustability of the axial position of said tooth.

33. A cutting tooth for use with the invention recited in claim 22 wherein said cutting tooth comprises a hardened, wear-resistant material formed from bar stock material.

* * * * *